US012384495B2

(12) United States Patent
Gai et al.

(10) Patent No.: US 12,384,495 B2
(45) Date of Patent: Aug. 12, 2025

(54) SUPPORT SYSTEM FOR OUTBOARD MARINE MOTORS AT THE TRANSOM OF A BOAT

(71) Applicant: Ultraflex S.p.A., Casella (IT)

(72) Inventors: Piero Gai, Busalla (IT); Marcella Gai, Busalla (IT); Enrico Pagani, Crocefieschi (IT)

( * ) Notice: Subject to any disclaimer, the term of this patent is extended or adjusted under 35 U.S.C. 154(b) by 602 days.

(21) Appl. No.: 17/689,753

(22) Filed: Mar. 8, 2022

(65) Prior Publication Data

US 2022/0289341 A1 Sep. 15, 2022

(30) Foreign Application Priority Data

Mar. 10, 2021 (IT) ..... 102021000005582

(51) Int. Cl.

| | |
|---|---|
| ***B63B 21/24*** | (2006.01) |
| ***B63B 21/26*** | (2006.01) |
| ***B63B 39/06*** | (2006.01) |
| ***B63B 39/14*** | (2006.01) |
| ***B63H 20/06*** | (2006.01) |
| ***B63H 20/10*** | (2006.01) |
| ***B63H 20/12*** | (2006.01) |

(Continued)

(52) U.S. Cl.

CPC ..... *B63B 21/243* (2013.01); *B63B 21/26* (2013.01); *B63B 39/061* (2013.01); *B63B 39/14* (2013.01); *B63H 20/06* (2013.01); *B63H 20/106* (2013.01); *B63H 20/12* (2013.01); *B63H 21/213* (2013.01); *B63H 25/02* (2013.01); *B63H 25/44* (2013.01); *B63H 2021/216* (2013.01); *B63H 2025/026* (2013.01)

(58) Field of Classification Search

CPC ..... B63B 21/243; B63B 21/26

See application file for complete search history.

(56) References Cited

U.S. PATENT DOCUMENTS

| | | | | |
|---|---|---|---|---|
| 5,186,666 A * | 2/1993 | Stanley | ..... | B63H 20/08 440/61 G |
| 7,958,837 B1 * | 6/2011 | Fraleigh | ..... | B63H 20/08 440/61 T |

(Continued)

FOREIGN PATENT DOCUMENTS

| | | | | |
|---|---|---|---|---|
| EP | 3241735 | 11/2017 | | |
| EP | 3241735 A1 * | 11/2017 | ..... | B63H 20/06 |
| WO | WO-2015130818 A1 * | 9/2015 | ..... | B63H 20/06 |

OTHER PUBLICATIONS

Italian Patent and Trademark Office, Search Report, Nov. 30, 2021 (Relevant portions are in English).

*Primary Examiner* — S. Joseph Morano
*Assistant Examiner* — Jovon E Hayes
(74) *Attorney, Agent, or Firm* — Themis Law

(57) ABSTRACT

A support system for outboard marine motors at the transom of a boat includes a support device having a first part that is integral with the transom and a second part that is integral with the outboard motor. The second part is translatable with respect to the first part, so that the second part moves according to an orientation in the distancing or approaching direction of the water line of the boat. A control unit is configured to set the position of the second part with respect to the first part and to generate control signals, so as to move the second part in the direction of immersion of the propeller of the outboard motor.

10 Claims, 4 Drawing Sheets

(51) Int. Cl.

| | |
|---|---|
| ***B63H 21/21*** | (2006.01) |
| ***B63H 25/02*** | (2006.01) |
| ***B63H 25/44*** | (2006.01) |

(56) References Cited

U.S. PATENT DOCUMENTS

| | | | | |
|---|---|---|---|---|
| 10,464,649 | B1 * | 11/2019 | Wood | B63H 20/106 |
| 2016/0288891 | A1 * | 10/2016 | Nyren | B63H 20/08 |
| 2018/0335788 | A1 * | 11/2018 | Behling | B63H 20/10 |
| 2020/0108902 | A1 * | 4/2020 | Wong | B63H 25/02 |

* cited by examiner

SUPPORT SYSTEM FOR OUTBOARD MARINE MOTORS AT THE TRANSOM OF A BOAT

FIELD OF THE INVENTION

The present invention relates to a support system for outboard marine motors at the transom of a boat.

The system comprises a device having a first part integral with the transom and a second part integral with the outboard motor.

The second part is mounted translatable with respect to the first part, such that the second part is translated according to an orientation in the distancing or approaching direction from the from the water line of the boat.

A control unit is further present, which is configured to set the position of the second part with respect to the first part.

BACKGROUND OF THE INVENTION

A jack plate is the common name of certain types of devices known in the art.

Such devices are commonly used in boats with outboard motors to move the outboard motor or motors with respect to the water line of the boat.

There are currently different types of jack plates, which are used to perform different functions.

There are both manual and automatic jack plates on the market, where the second part is moved with respect to the first part through mechanical means, electro-mechanical or electro-hydraulic actuators.

Furthermore, the jack plates are mounted on the transom so as to be able to move the outboard marine motors not only according to a vertical axis, but also according to a direction away from the transom, or according to a combination of different directions.

An example of possible combinations of movement of outboard motors is described in document EP3643598, owned by the applicant, the content of which is to be considered an integral part of the present description.

In one aspect, the field of the present invention relates to the control of jack plates and includes generating controls aimed at setting the position of the outboard motors and not to a manual movement of the outboard motors.

The generation of the control signals can occur manually, through a control set by a user, or automatically, according to, for example, certain operating parameters of the boat.

The need for the use of jack plates arises from a need to optimise the thrust generated by the propellers of the outboard marine motors, which should always be at a certain height below the float level of the boat, so as to make the best use of its drive to impart the correct propulsion to the boat.

The movement of the second part with respect to the first part allows the outboard motor to be brought closer to/farther away from the boat's water line, so that the propeller is always at least partially, if not entirely, immersed in water.

A certain degree of immersion in water not only allows optimizing the propulsion of the propeller, but also avoids propeller breakage due to problems of overheating: in fact, the rotation of a propeller which is not submerged is not counteracted by the resistance of water, the propeller risks "over-revving", causing sudden overheating which leads to the breakage of the motor.

To avoid such a problem, some jack plates known in the state of the art include an adjustment of the movement of the second part with respect to the first, based on the speed of the boat, so as to lower the motor as the speed increases, preventing the propeller from exiting the water.

Such an approach does not, however, solve the problem of the propeller overheating as the boat not only does not have constant trends, but also moves on a surface, that of water, which causes continuous vertical movements of the boat, causing the propeller of the outboard motors to exit from the water, regardless of the speed.

There is therefore a need, which is not satisfied by the state of the art to overcome the above-described disadvantages.

SUMMARY OF THE INVENTION

The present invention achieves the above-described objects by providing a support system for outboard marine motors, in which the control unit is configured to generate control signals so as to move the second part in the immersion direction of the propeller of the outboard motor.

Regardless of the type and nature of the control signals, the control signals can be set by a user through the control unit, or, alternatively or in combination, generated automatically by the control unit itself.

In the first case it is possible to envisage that the control unit generates warning signals to the user, based on certain navigation parameters.

According to the present invention, the movement of the second part in the immersion direction of the propeller can occur based on two pre-set parameters, to be included alternatively or in combination.

According to a first embodiment, a system according to the present invention comprises a sensor for detecting the immersion of the propeller of the outboard motor.

Such a detection sensor is aimed at evaluating the "wettability" of the motor, i.e., how much the outboard motor, in particular the propeller, is wetted by the surrounding water.

The detection has a double effect.

Firstly, in the case of the detection of no wettability, i.e., water presence values at the propeller below a certain threshold value, it is possible to envisage that the second part is moved to bring it closer to the water line, in order to increase the immersion of the propeller.

Alternatively or in combination, it is possible to envisage that a control signal is generated which is aimed at limiting or blocking the rotation of the propeller, in order to avoid overheating.

The control signals for lowering the second part and blocking the rotation of the propeller can, as anticipated, be generated automatically by the control unit and/or by a user, following warning signals generated by the control unit following the detection of the wettability of the propeller.

According to a preferred embodiment, a system according to the present invention comprises a system for detecting the inclination of the boat with respect to the rolling direction.

Such a feature allows to detect the inclination of the boat and possibly control the movement of the second part, based on the inclination.

For example, during a turn, the boat may incline so that the propeller of the outboard motor emerges from the water.

Thereby, if threshold inclination values are reached, the control unit could generate control signals which move the second part in the direction of the water line, so as to immerse the propeller.

Such a solution is particularly advantageous in the case of two outboard motors, of which each motor is supported by a corresponding support device.

In fact, the control unit could control the support devices so as to bring the second part closer to the water line of the boat so that the motor "external" to the turn makes a greater movement than the motor "internal" to the turn.

Such an approach not only allows to avoid the overheating of the propellers, but also to optimize the thrust generated by the propellers, since both motors, even in the case of turning, are in the ideal immersion condition, i.e., capable of generating the maximum propulsion with the same power.

A support system according to the present invention, therefore, has the main object of adjusting the movement of the outboard motors, avoiding the propellers of such motors from being not immersed in water during navigation.

The immersion condition of the propellers can also be monitored with additional sensors of a system according to the present invention, which communicate with the control unit in order to correctly set the position of such outboard motors.

For this reason, according to a possible embodiment, a system according to the present invention comprises at least one linear position sensor, configured to detect the position of the second part.

The position sensor can detect the position along one or more axes and can be positioned either on the second part or on the outboard motor.

The position sensor can refer to a reference value which allows the correct position of the outboard motor to be evaluated.

The position sensor works synergistically with the boat's inclination detection system, as it provides feedback to the user regarding a correct motor position following the positioning of the second part performed by the control unit.

Furthermore, the presence of the position sensor has a particularly advantageous aspect as it allows to obtain a fine adjustment of the positioning of the outboard motors.

In fact, the support device could move the second part in different directions by integrating the information of the position sensor(s) and those of the inclination detection system.

The same advantages can be obtained when a system according to the present invention comprises a rotary position sensor, configured to detect the rotation of the outboard motor with respect to the transom of the boat.

According to a further embodiment, a system according to the present invention includes a device for detecting the depth of the seabed.

In particular, in combination with the variant which includes generating automatic control signals, a system according to the present invention can have a depth gauge so as to lift the motor automatically when it arrives near shallow water.

Near shallow water, the boat navigates at limited speeds, so it is particularly effective to move the motor frequently, which allows avoiding impacts with the seabed.

According to a further embodiment, the depth gauge can be connected to a log to optimize the position of the second parts, and thus of the motor, automatically and to improve the efficiency of the motor, especially in terms of consumption, speed, etc.

For the generation of automatic control signals regarding the position of the second parts, advantageously the signals detected by the depth gauge and by the log are communicated to the control unit, which processes them and generates control signals for setting the position of the second parts.

Advantageously, the information detected by the various sensors and detection systems can be communicated to a user through a display unit.

The display unit can communicate values to a user which serve as feedback for adjusting the position of the motors or can create a virtual model of the motors, so as to identify the correct position during navigation.

In view of the advantageous aspects described above related to a support system for outboard marine motors, the present invention also relates to a method for governing a boat comprising one, two or more outboard motors, which method includes moving at least one of the motors according to a path with at least one motion component having an orientation in the distancing or approaching direction from the water line of the boat, so that the movement is performed based on the immersion condition of the propeller of the outboard motor.

As anticipated for the system, a method according to the present invention also allows adjusting the positioning of the outboard motor(s) in order to avoid the propellers of the propulsion motors overheating, ensuring an optimal degree of immersion of the latter.

According to a preferred embodiment, the immersion condition is calculated based on the inclination of the boat with respect to the rolling direction.

In the case of two outboard motors, a method according to the present invention, during a turn, envisages making the motor "external" to the turn move more with respect to the "internal" motor during the turn.

Alternatively or in combination, a method according to the present invention includes calculating the immersion condition through the detection of a sensor positioned at the propeller and configured to detect the presence of water.

Finally, the present invention relates to a boat with at least one hull comprising a transom, to which transom is fixed a support system for at least one outboard motor.

In particular, the support system can be made according to one or more of the features, alternatively or in combination, described above.

Accordingly, the boat according to the present invention has all the above-described advantages, which relate to the support system of one or more outboard motors.

Such advantages have an additional relevant aspect in the embodiment, which envisages that the boat has a wing element placed below the hull.

A boat is therefore obtained with one or more wing elements, such as foils or the like, which has an automatic height adjustment of the outboard motors.

Boats with foils known in the state of the art are lifted after having reached a certain speed, so as to navigate on the foils, i.e., glide on the water, using the surface of the foils.

Such lifting causes the propellers to exit from the water, for this reason the boats with the known state-of-the-art foils have outboard motors with stems of high length, so as to always ensure the immersion of the propellers in the water, even if the boat lifts.

However, such stems are particularly inconvenient and inefficient during normal navigation, i.e., when the boat is not gliding on the surface of the wing elements.

A boat according to the present invention, on the other hand, allows avoiding such a problem, obtaining an automatic adjustment of the height of the outboard motors, so that the propulsion propellers are always immersed, regardless of the degree of elevation of the boat with respect to the surface of the water.

BRIEF DESCRIPTION OF THE DRAWINGS

These and other features and advantages of the present invention will become clearer from the following description of some exemplary embodiments illustrated in the accompanying drawings in which.

DETAILED DESCRIPTION OF EMBODIMENTS OF THE INVENTION

It should be noted that the embodiments shown in the figures attached to the present application are shown to better understand the advantages and features of the system and the method claimed below.

Such embodiments are, therefore, to be understood for purely illustrative purposes and not limited to the inventive concept of the present invention, namely to create a support system for outboard motors which allows positioning such motors in order to obtain an optimal degree of immersion thereof, in order to avoid the overheating of the propulsion propellers and in order to ensure the maximum propulsion thrust, with the same power.

Figure 1:
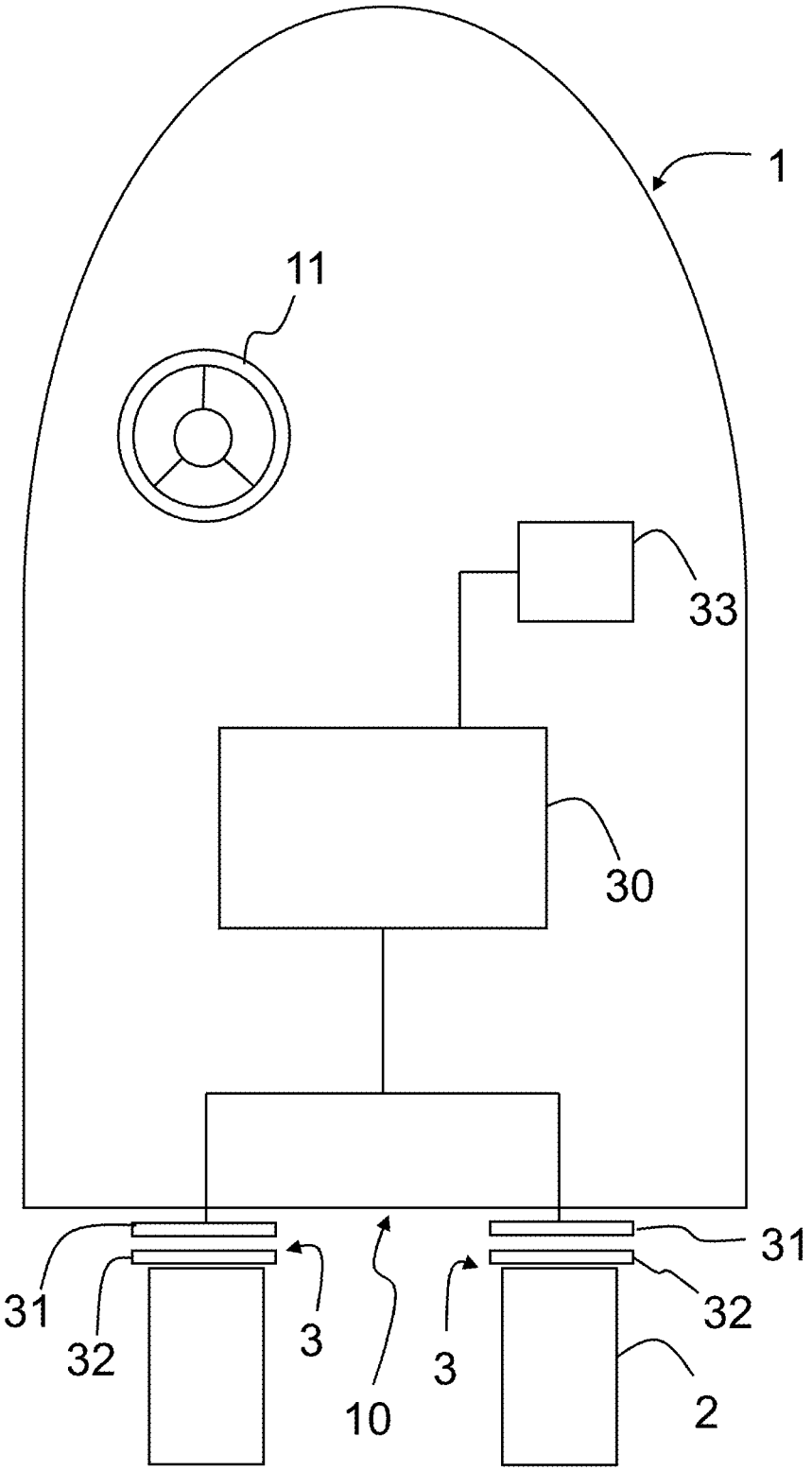
FIG. 1 illustrates an exemplary diagram of a possible embodiment of a system according to the present invention.

With particular reference to FIG. 1, a concept diagram of an embodiment of a system according to the present invention is illustrated.

In fact, a support system of outboard motors 2 at the transom 10 of a boat 1 is illustrated, which comprises at least one support device 3.

The support device 3 includes a first part 31 integral with the transom 10 and a second part 32 integral with the outboard motor 2.

The second part 32 is mounted translatable with respect to the first part 31, such that the motor 2 can be moved with respect to the transom 10.

The boat 1 comprises a control member, of the wheel type 11 or the like, which sets the navigation direction.

According to the variant illustrated in FIG. 1, the boat 1 comprises two outboard motors 2 fixed to the transom 10 through two corresponding support devices 3.

The support devices 3 can thus consist of the devices known as jack plates and can thus be made in any of the ways known in the state of the art.

According to a preferred variant of a system according to the present invention, the support devices 3 allow the approaching or distancing movement of the motors 2 with respect to the water line of the boat, i.e., with respect to the plane of FIG. 1.

As described above, adjusting the motors along such a direction, allows to obtain a greater or lesser immersion of the propulsion propellers, in order to optimize the propulsion thrust and to allow a correct cooling of the propellers themselves.

Regardless of their embodiment, the support devices 3 are controlled by a control unit 30 configured to generate control signals aimed at setting the position of the second part 32 with respect to the first part 31, i.e., aimed at adjusting the position of the outboard motors 2 with respect to the transom 10.

As anticipated and as will be apparent from the following illustration, the control signals can be generated automatically by the control unit or can be set by a user through the control unit.

In the first case, it can be envisaged that the signals are generated automatically based on certain parameters detected by a sensor system which will be described later.

In the second case, which can be envisaged alternatively or in combination with the first, a user can set the controls through a control panel 33 which communicates with the control unit 30.

It can also be envisaged that, based on the navigation parameters, the system suggests the positioning of the second parts 32 to the user and the user validates the suggestion by setting the positioning through a control sent to the control unit 30.

For example, it can be envisaged that the boat 1 is in a navigation condition which requires both motors 2 to be lowered.

The user can independently decide to lower both motors through a control set at the control panel 33 which communicates with the control unit 30 and which in turn generates a control signal aimed at setting the position of the second parts 32 with respect to the first parts 31, so as to lower the motors 2 with respect to the transom 10.

Alternatively or in combination, the sensor system (which will be described later), sends information to the control unit 30, which processes such information and identifies the navigation condition which requires the motors to be lowered and two configurations are possible.

According to a first configuration, the control signals are generated automatically and the control unit 30 lowers/raises the motors 2.

Based on a second configuration, the control unit 30 suggests settings to the user related to the positioning of the motors and the user can decide to validate such settings.

The control unit 33 can include a display unit on which to display the information detected by the sensor system and/or the suggested positioning settings of the motors 2.

Figure 2A:
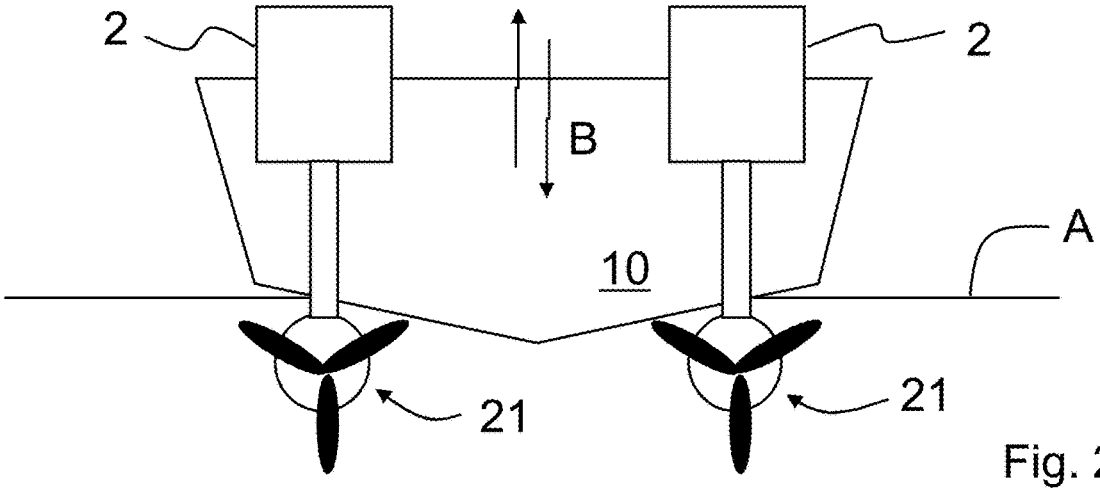
FIGS. 2*a* to 2*c* illustrate a rear view of the boat on which the system of the present invention is included, according to three different navigation conditions.
Figure 2B:
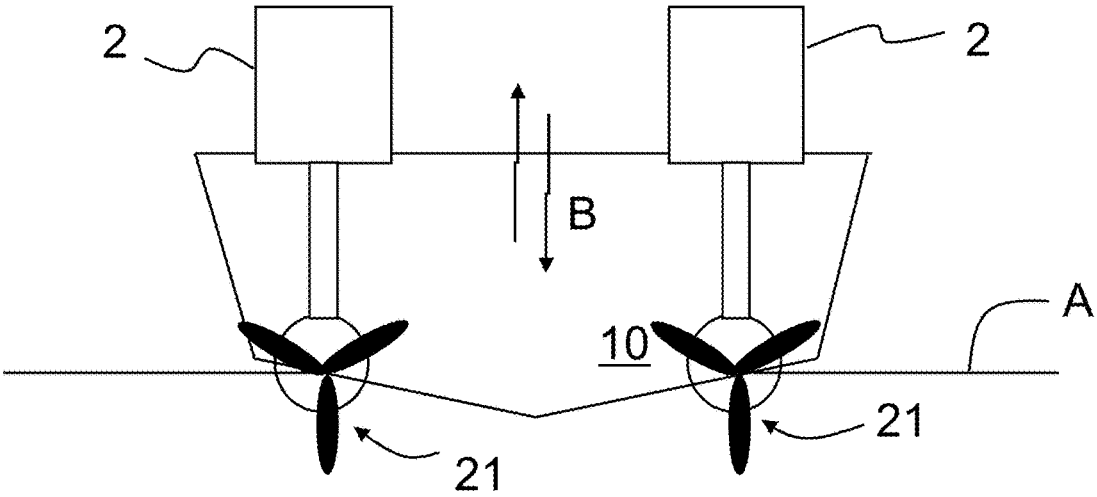

FIGS. 2*a* and 2*b* illustrate a concept diagram of a rear view of the boat 1, in which the transom 10 and the two outboard motors 2 with corresponding propulsion propellers 21 are shown.

As anticipated, the outboard motors 2 can approach or move away from the water line A, according to the direction indicated by the arrows B.

The control unit 30 is configured so as to be able to control the approaching/distancing of the motors 2 from the water line A separately, i.e., so that the motors can be moved independently and also in opposite directions.

A system according to the present invention may control the second parts 32 of the support devices so that their movement has at least one motion component facing away from/approaching the water line A.

Such movement can be obtained by the combination of one or more movements, as described in document EP3643598, the contents of which are to be considered an integral part of the present description.

In particular, FIG. 2*a* illustrates the optimal condition, i.e., the condition in which the propulsion propellers 21 are both immersed below the water line A.

In this condition, the optimum propulsion thrust is obtained and the propellers 21 do not risk excessive overheating, due to "over-revving" phenomena, by virtue of the water resistance.

FIG. 2*b*, on the other hand, shows a condition in which the propulsion propellers 21 have mainly emerged from the water and are located above the water line A, a condition which is better avoided due to the probable phenomena of overheating of the propellers themselves.

The control unit 30 is therefore configured so as to generate control signals so as to allow the continuous immersion of the propulsion propellers 21.

As anticipated, such control signals are generated based on the sensor system detections.

According to a preferred embodiment, the sensor system comprises a detection system for detecting the inclination of the boat with respect to the rolling direction.

Such a detection system can consist, for example, of an inertial platform, placed in any position, for example integrated within the support devices 3.

Preferably, the inertial platform detects the inclination of the boat 1 with respect to the rolling direction, so as to detect the turns of the boat itself.

In the event of turning, in fact, the boat changes the inclination and the two motors 2 would be at different heights, with one motor at a higher height with respect to the other motor.

Figure 2C:
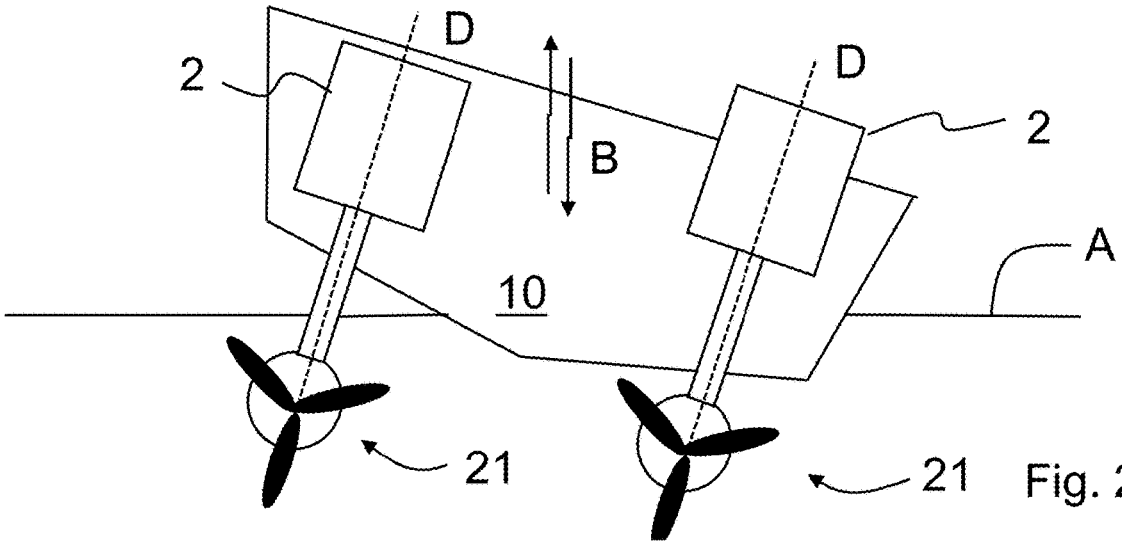

FIG. 2*c* illustrates a turn of the boat 1 to the starboard side (right side of FIG. 2*c*): in the absence of a system according to the present invention, the "internal" motor to the turn, i.e., the right motor would be at a lower level than the motor "external" to the turn, i.e., the left motor.

It follows that the propeller 21 of the internal motor would be submerged with respect to the water line A, while the propeller 21 of the external motor would be emerged or partially emerged with respect to the water line A.

In the event of the presence of a system according to the present invention, as illustrated in FIG. 2*c*, the inertial platform detects such an inclination and sends the information to the control unit 30, which sets, according to the methods described above, the correct position of the motors 2, moving the second parts 32 of the support devices 3.

The outboard motor 2 "internal" to the turn can therefore not be moved, if the turn keeps the corresponding propeller 21 submerged.

The outboard motor 2 "external" to the turn is instead lowered in the direction of the water line A, so that the propeller 21 is submerged.

FIG. 2*c* shows the movement of marine motors along an axis perpendicular to the horizontal plane of the boat, i.e., along the axis D.

It follows that the second parts 32 move along slides or tracks included on the first part 31.

Figure 3A:
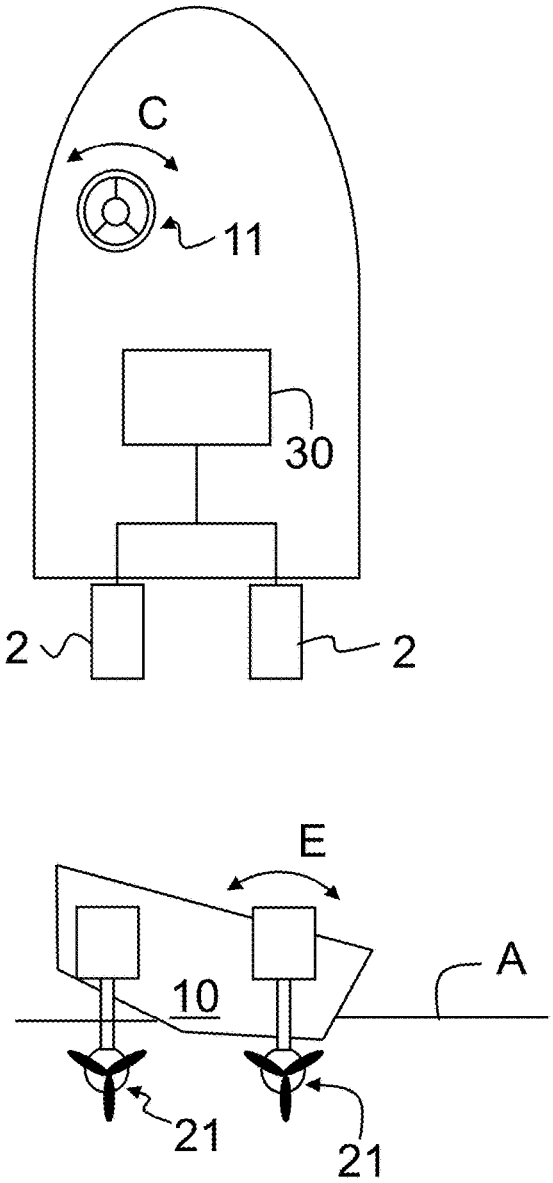
FIGS. 3*a* and 3*b* illustrate a top view and a rear view of the boat on which a system according to the present invention is included, according to two different navigation conditions.
Figure 3B:
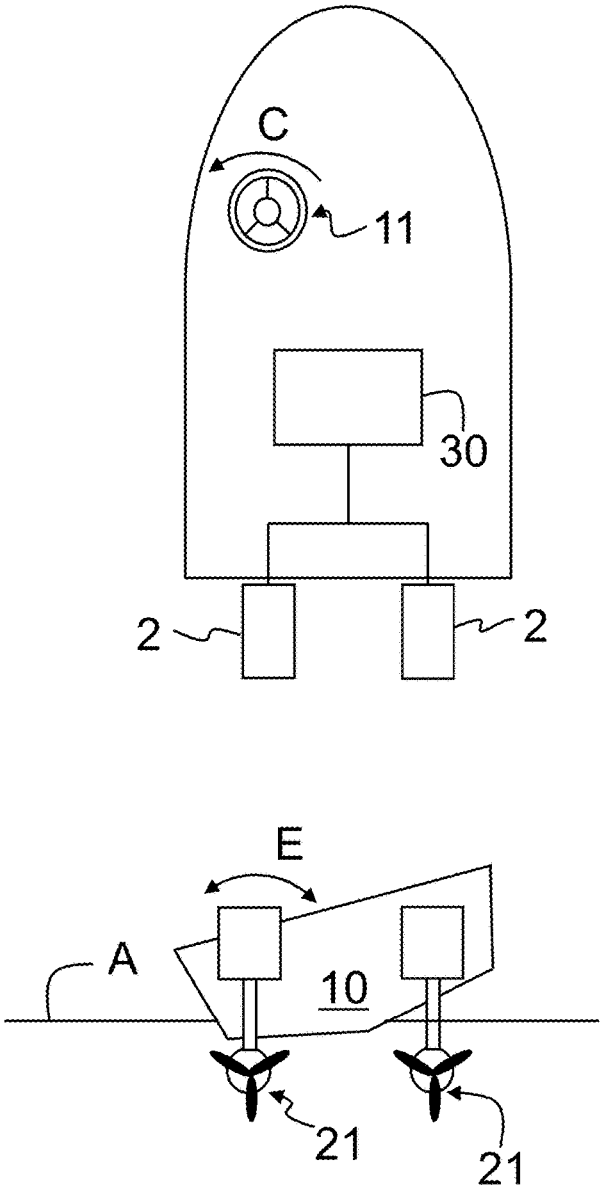

FIGS. 3*a* and 3*b* illustrate such an operating scheme.

In FIG. 3*a*, the user makes a turn on the starboard side, indicated by the direction of the arrow C, the boat 1 tilts and the control unit 30 makes the external motor 2 (i.e., the left motor with reference to FIG. 3*a*) perform a greater stroke with respect to that of the internal motor of the turn.

Conversely, in FIG. 3*b*, the user makes a turn on the port side, indicated by the direction of the arrow C, the boat 1 tilts and the control unit 30 makes the external motor 2 (i.e., the right motor with reference to FIG. 3*b*) perform a greater stroke with respect to the internal motor of the turn.

Thereby, the propulsion propellers 21 always have an optimal level of immersion, without the risk that they excessively exit from the water line A.

Preferably, but not exclusively, during the turns, the motors 2 can always be at the same height.

Furthermore, it is envisaged that the navigation conditions require that only one of the two motors is moved during the turns of the boat, as often occurs, since the internal of the turn is always below the water line.

It is evident how FIGS. 3*a* and 3*b* can envisage the configuration of the motors of FIG. 2*c*, i.e., motors moving along the direction of the axis D.

Alternatively, as illustrated in FIGS. 3*a* and 3*b*, the second parts 32 can be mounted on the first parts 31, so that the outboard motors 2 can rotate about the longitudinal axis of the boat 1.

It follows that the outboard motors, in addition to approaching/moving away from the water line A, will always be perpendicular to such a water line A.

The rotation of the outboard motor with respect to the longitudinal axis of the boat 1, i.e., with respect to the arrow E, can be controlled by the control unit 30, or alternatively or in combination, it can be free.

In the first case, the inertial platform can indicate to the control unit the correct rotation to be set to the outboard motors 2.

In the second case, the force of gravity can cause the outboard motors 2 to be perpendicular to the water line A.

In order to enhance these latter features, the system comprises further sensors aimed at enriching the information in the possession of the control unit 30 and aimed at obtaining an increasingly fine and precise adjustment of the movements of the motors.

Thus, the sensor system can comprise a sensor aimed at detecting the amount of water at the propulsion propellers, in order to evaluate the immersion of the propulsion propellers 21.

According to an embodiment, position sensors can be included, aimed at detecting the position of the motors.

For example, it is possible to compare the position of one motor with respect to another, so that they are always in line with each other, as shown in FIGS. 3*a* and 3*b*.

The position sensors can thus provide feedback on the correct positioning of the motors, especially following a movement performed by the control unit 30, for example during a turn.

The position sensors can refer to a fixed reference point, integral with the transom, so as to evaluate the position of each motor with respect to such a fixed reference and thus compare the position of one motor with respect to the other.

As described above, the support device 3 can be mounted on any boat and is preferably mounted on the transom of the boat's hull.

FIGS. 4*a* to 4*d* illustrate four views of a boat according to the present invention according to an embodiment, in which the boat consists of foils.

In fact, the hull 1 has two wing elements 4 placed below the hull itself.

Figure 4A:
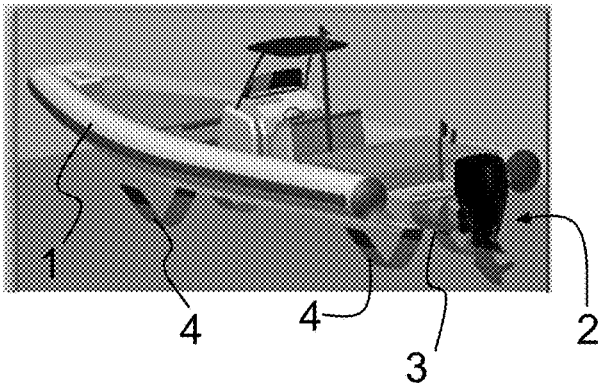
FIGS. 4*a* to 4*d* show some views of a possible embodiment of a boat according to the present invention.
Figure 4B:
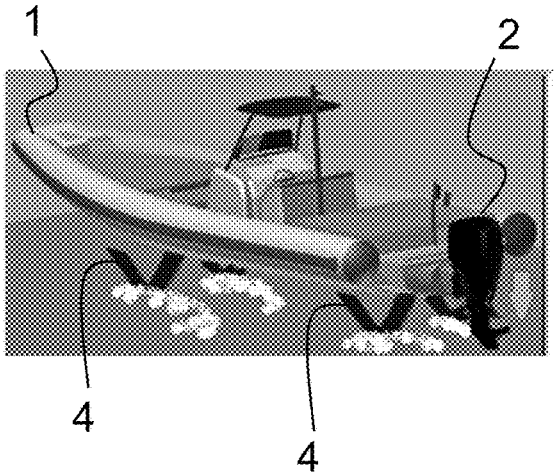
Figure 4C:
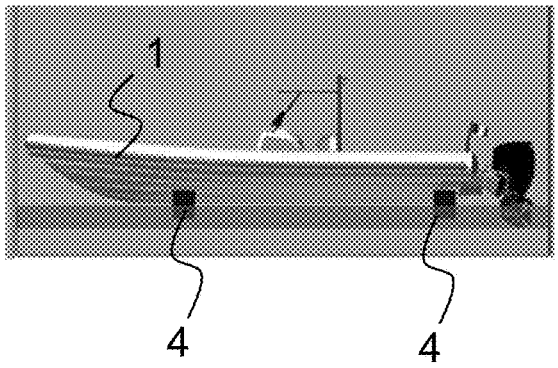
Figure 4D:
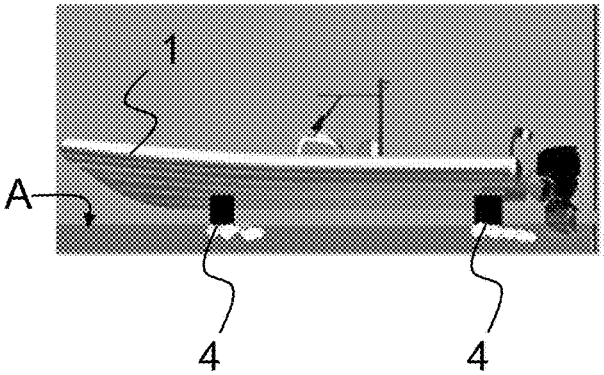

The boat 1 passes from a floating condition, FIGS. 4*a* and 4*c*, to a gliding condition on the surface of the wing elements 4, FIGS. 4*b* and 4*d*.

At low speeds, FIGS. 4*a* and 4*c*, the boat is located with the hull partially immersed below the water line A, while, increasing the speed, FIGS. 4*b* and 4*d*, it rises with respect to the water line A, gliding on the surface of the wing elements 4.

As illustrated in the figures, regardless of the degree of lift of the boat with respect to the water line A, the propulsion propellers of the outboard motors 2 are always submerged below the water line, by virtue of the automatic adjustment of the positioning of the outboard motors, according to one or more of the methods described above.

While the invention is susceptible to various modifications and alternative constructions, some preferred embodiments have been shown in the drawings and described in detail.

It should be understood, however, that there is no intention of limiting the invention to the specific illustrated embodiment but, on the contrary, it aims to cover all the modifications, alternative constructions, and equivalents falling within the scope of the invention as defined in the claims.

The use of "for example", "etc.", "or" refers to non-exclusive non-limiting alternatives, unless otherwise stated.

The use of "includes" means "includes but not limited to", unless otherwise stated.

The invention claimed is:

1. A support system for an outboard motor at a transom of a boat, comprising:

a support device comprising a first part integral with the transom and a second part integral with the outboard motor, the second part being mounted to be translatable with respect to the first part, so that the second part is disposed to be translated according to an orientation in a distancing or approaching direction from a water line of the boat;

a control unit configured to set a position of the second part with respect to the first part, wherein the control unit is configured to generate control signals so as to cause a propeller of the outboard motor to be immersed in water at all times during navigation by moving the second part in an immersion direction of the propeller of the outboard motor; and a detection system configured to detect an inclination of the boat with respect to a rolling direction, the control unit causing a lowering of the propeller by lowering the second part when the inclination exceeds a predetermined angle.

2. The support system according to claim 1, further comprising a sensor configured to detect an amount of immersion of the propeller of the outboard motor in the water.

3. The support system according to claim 1, wherein there are two support devices fixed to the transom of the boat.

4. The support system according to claim 1, further comprising a linear position sensor configured to detect a position of the second part.

5. The support system according to claim 1, further comprising a rotary position sensor configured to detect a lateral rotation of the outboard motor with respect to the transom of the boat.

6. The support system according to claim 1, further comprising a detection device configured to detect a depth of a seabed.

7. A method of managing a boat having at least one outboard motors, the method comprising:

moving at least one of the motors according to a path with at least one motion component having an orientation in a distancing or approaching direction from the boat's water line, wherein a movement is performed based on an immersion condition of a propeller of the at least one outboard motor, and wherein the immersion condition is calculated based on a lateral inclination of the boat with respect to a rolling direction.

8. The method according to claim 7, wherein the immersion condition is calculated through a detection by a sensor positioned at a propeller of the outboard motor and configured to detect a presence of the water.

9. A boat comprising a hull, the hull comprising:

a transom; and a support system of at least one outboard motor fixed to the transom, wherein the support system is configured according to claim 1.

10. The boat according to claim 9, wherein the hull comprises at least one wing element extending below the hull.

* * * * *